US007515058B2

(12) United States Patent
Normand

(10) Patent No.: US 7,515,058 B2
(45) Date of Patent: Apr. 7, 2009

(54) CARBON MONOXIDE DETECTOR AND METHOD OF INSTALLATION

(76) Inventor: William Normand, 45 Witham St., Gloucester, MA (US) 01930

( * ) Notice: Subject to any disclaimer, the term of this patent is extended or adjusted under 35 U.S.C. 154(b) by 223 days.

(21) Appl. No.: 11/454,695

(22) Filed: Jun. 16, 2006

(65) Prior Publication Data

US 2007/0290870 A1 Dec. 20, 2007

(51) Int. Cl.
*G08B 17/10* (2006.01)

(52) U.S. Cl. ..... 340/632; 340/693.9; 340/538

(58) Field of Classification Search ..... 340/632, 340/693.9–693.12, 310.18, 539.26, 538, 340/538.17

See application file for complete search history.

(56) References Cited

U.S. PATENT DOCUMENTS

| | | | | | |
|---|---|---|---|---|---|
| 3,590,271 | A | * | 6/1971 | Peters | 340/310.18 |
| 4,121,201 | A | * | 10/1978 | Weathers | 340/568.3 |
| 4,386,338 | A | * | 5/1983 | Doyle et al. | 340/310.18 |
| 4,737,769 | A | * | 4/1988 | Masot | 340/538 |
| 5,424,587 | A | * | 6/1995 | Federowicz | 340/310.18 |
| 5,555,455 | A | | 9/1996 | McGinley | 340/627 |
| 5,684,467 | A | * | 11/1997 | Hur | 340/693.9 |
| 5,786,767 | A | | 7/1998 | Severino | 340/628 |
| 5,798,945 | A | | 8/1998 | Benda | 364/550 |
| 5,889,468 | A | | 3/1999 | Banga | 340/628 |
| 5,905,438 | A | * | 5/1999 | Weiss et al. | 340/636.1 |
| 5,905,442 | A | | 5/1999 | Mosebrook et al. | 340/825 |
| 5,999,094 | A | * | 12/1999 | Nilssen | 340/538 |
| 6,133,843 | A | * | 10/2000 | Davidson | 340/693.9 |
| 6,144,310 | A | | 11/2000 | Morris | 340/692 |
| 6,249,223 | B1 | | 6/2001 | Christensen | 340/540 |
| 6,380,852 | B1 | * | 4/2002 | Hartman et al. | 340/310.18 |
| 6,420,973 | B2 | | 7/2002 | Acevedo | 340/628 |
| 6,441,723 | B1 | | 8/2002 | Mansfield, Jr. et al. | 340/310.01 |
| 6,492,907 | B1 | * | 12/2002 | McCracken | 340/628 |
| 6,989,757 | B2 | | 1/2006 | Geoffrey et al. | 340/632 |
| 7,273,983 | B1 | * | 9/2007 | Rintz | 174/66 |
| 7,283,048 | B2 | * | 10/2007 | Stilp | 340/539.11 |
| 2003/0062990 | A1 | * | 4/2003 | Schaeffer et al. | 340/310.01 |
| 2004/0032335 | A1 | | 2/2004 | Parrish | 340/628 |
| 2004/0160329 | A1 | | 8/2004 | Flanc | 340/632 |

OTHER PUBLICATIONS

Mass. General Laws—527 CMR 31:00.
"Carbon monoxide detectors now law" by Carolyn Y. Johnson, The Boston Globe, Saturday, Nov. 5, 2005.

* cited by examiner

*Primary Examiner*—John A Tweel, Jr.
(74) *Attorney, Agent, or Firm*—Burns & Levinson LLP; Jacob N. Erlich, Esq.; Yakov Korkhin, Esq.

(57) ABSTRACT

A carbon monoxide detector and method for installing a carbon monoxide detector. The carbon monoxide detector is capable of being hardwired into an installed wall electrical outlet box without reduction of the number of available electrical receptacles.

13 Claims, 5 Drawing Sheets

CARBON MONOXIDE DETECTOR AND METHOD OF INSTALLATION

FIELD OF THE INVENTION

The present invention relates generally to the field of gas detectors, and, more particularly, to a carbon monoxide detector for retrofitting to an existing wall electrical outlet box installed in a dwelling or other enclosed structure.

BACKGROUND OF THE INVENTION

Carbon monoxide is a hazardous substance, which occupies sites in red blood cells necessary for binding oxygen. In sufficient concentrations, carbon monoxide may diminish replenishment of oxygen to tissues to a lethal degree.

Within a dwelling or other enclosed structure, there may be several important sources of carbon monoxide, including furnaces, fireplaces, water heaters, and clothes dryers. Ideally, all sources of carbon monoxide are properly vented to the outside. However, vents may be blocked, unbeknownst to residents. Clothes dryer vents may fill with lint, furnace vents with soot, and chimneys with bird nests. The danger is most acute in winter when supplemental ventilation through opened windows is absent.

Installation of present carbon monoxide detectors may be problematical. Many detectors are powered by batteries. However, although there may be an audible warning of low battery voltage, frequently, batteries are not replaced, resulting in an inoperative detector. Other detectors operate on voltages obtained by plugging the detector into a wall outlet. However, the plug may be displaced or disengaged, as during cleaning, and the carbon monoxide detector consequently lacking electrical power. Even more importantly, users of a carbon monoxide detector tend to deactivate or remove the device upon a false reading or false alarm.

Safer and more reliable is hardwiring the carbon monoxide detector to the building or residence wiring. However, in contrast to installation during new construction, installation is not straightforward when dealing with an existing residence or structure, as installation can involve pulling additional wires and installing additional wall electrical outlet boxes. These tasks add significantly to the cost of permanent carbon monoxide detector installation and result in the installation of the less preferable battery or plug-in carbon monoxide detectors.

There would be advantage to a carbon monoxide detector amenable to permanent professional installation in existing structures without the necessity of installing new wiring.

SUMMARY OF THE INVENTION

The needs of the invention set forth above as well as further and other needs and advantages of the present invention are achieved by the embodiments of the invention described herein below.

According to one aspect of the present invention, a carbon monoxide detector includes a controller, a notification device, a carbon monoxide sensor, and two or more electrical terminals. The carbon monoxide sensor and the notification device are coupled to the controller. The controller is a source of a signal to the notification device upon receipt of another signal from the carbon monoxide sensor. The other signal is indicative of the presence of carbon monoxide. The carbon monoxide detector is configured to fit within a wall electrical outlet box.

In certain embodiments according to the present invention, the notification device may be a visual notification device and, in other embodiments of the present invention, the notification device may be an audible notification device. In further embodiments according to the present invention, the carbon monoxide detector may further comprise a sensing device. The sensing device may be coupled to the controller and be responsive to a further signal different from the controller signal and the another signal, the further signal emitted by another notification device of another carbon monoxide detector. The sensing device may be a wireless sensing device. In some embodiments of the present invention, the carbon monoxide detector may include a wireless transmitter.

In other embodiments according to the present invention, the carbon monoxide detector may further comprise at least one electrical receptacle. The at least one electrical receptacle may be a duplex receptacle. The at least one electrical receptacle may be integral with the carbon monoxide detector.

In some embodiments according to the present invention the wall electrical outlet box may be in combination with the wall electrical outlet box, which includes electrical wires. The electrical wires may be connected to electrical terminals of the carbon monoxide detector and the wall electrical outlet box may be installed within a structure. The structure may include a wall, and the carbon monoxide detector, when mounted within the wall electrical outlet box, may be substantially flush with the wall. The electrical terminals may be electrical wires. In other embodiments of the present invention, the carbon monoxide detector may include a battery.

According to another aspect of the present invention, a method for retrofitting an installed wall electrical outlet box with a carbon monoxide detector includes the steps of removing a source of electrical power from the installed wall electrical outlet box, removing a cover plate from the installed wall electrical outlet box, removing an at least one duplex receptacle from the installed wall electrical outlet box, installing the carbon monoxide detector in the installed wall electrical outlet box, and reinstating the source of electrical power to the installed wall electrical outlet box.

According to an additional embodiment of the present invention, removing an electrical outlet may include disconnecting the at least one duplex receptacle from at least one installed wire. Installing the carbon monoxide detector may include coupling at least one electrical terminal of the carbon monoxide detector to the at least one installed wire. Coupling the carbon monoxide detector to the at least one installed wire may include coupling at least one electrical receptacle to the at least one installed wire.

According to another embodiment of the present invention, the at least one electrical receptacle may be integral with the carbon monoxide detector. According to a further embodiment of the present invention, the at least one electrical terminal may be an at least one wire.

For a better understanding of the present invention, together with other and further objects thereof, reference is made to the accompanying drawings and detailed description and its scope will be pointed out in the appended claims.

BRIEF DESCRIPTION OF THE DRAWINGS

For a better understanding of the present invention, reference is made to the figures, in which.

DETAILED DESCRIPTION OF THE INVENTION

Figure 1A:
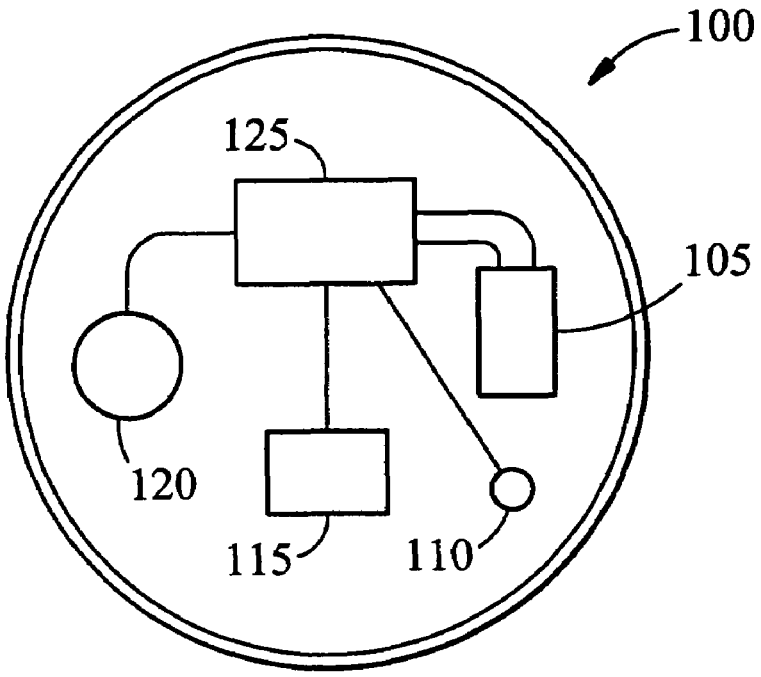
FIG. 1A (Prior Art)
FIG. 1A is a schematic illustration of a prior art battery-operated carbon monoxide detector.

FIG. 1A shows a schematic illustration of a prior art battery-powered carbon monoxide detector 100. In addition to a battery 105, the carbon monoxide detector 100 also contains a battery indicator light 110 showing whether sufficient voltage exists within the battery 105, an audible alarm 115 indicating when carbon monoxide levels have exceeded a threshold, and a carbon monoxide sensor 120. The audible alarm 115 and the carbon monoxide sensor 120 are electrically connected to a controller 125 that monitors for a signal from the carbon monoxide sensor 120 and, for a signal exceeding a threshold, sends a signal to the audible alarm 115 to activate the audible alarm 115.

Figure 1B:
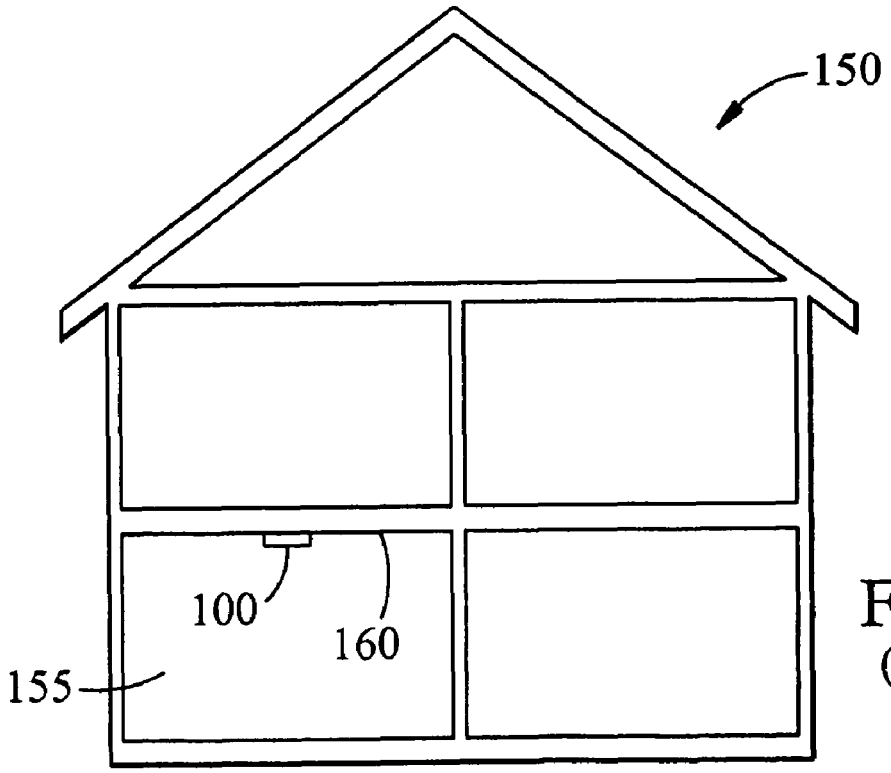
FIG. 1B (Prior Art)
FIG. 1B is a schematic illustration of a prior art battery-operated carbon monoxide detector installed in a dwelling.

FIG. 1B illustrates a schematic illustration of an installation of a battery-operated carbon monoxide detector 120 mounted on a ceiling 160 within a room 155 of a dwelling or structure 150. Rooms 155 selected for monitoring generally are near sleeping quarters or adjacent to areas where carbon monoxide may be generated. Examples include areas include near garages, near clothes dryers, near furnaces, and near fireplaces. Regulations may require carbon monoxide detectors and alarms at every level, including habitable portions of basements and attics, and basements where there are boilers, furnaces, and hot water heaters. On levels with sleeping areas, there may be requirements to locate carbon monoxide detectors within ten feet of bedroom doors.

There are disadvantages associated with the battery-operated carbon monoxide detector 120. Disadvantages include continued maintenance as batteries wear out and require replacement, purposeful deactivation by removal of batteries in response to false detections, and noncompliance with recent codes requiring permanent installation of carbon monoxide detectors.

Figure 2A:
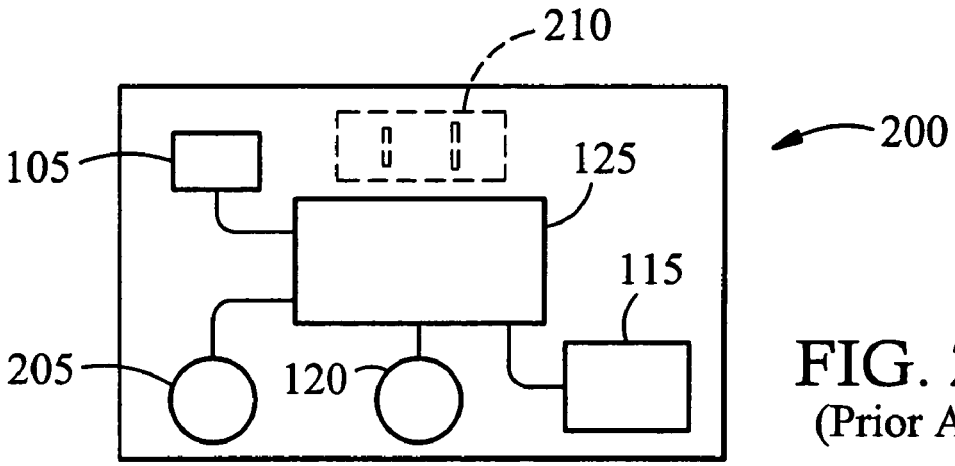
FIG. 2A (Prior Art)
FIG. 2A is a schematic illustration of a prior art plug-in carbon monoxide detector.
Figure 2B:
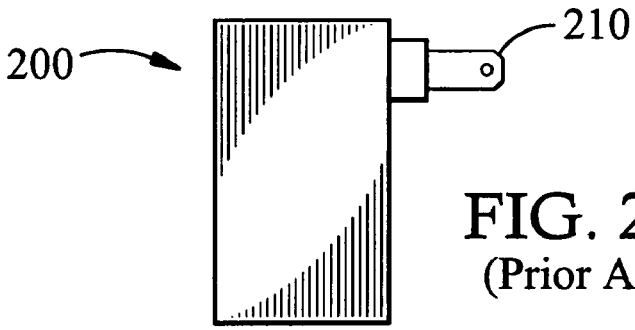
FIG. 2B (Prior Art)
FIG. 2B is a schematic illustration of a side view of a prior art plug-in carbon monoxide detector.

FIG. 2A shows a schematic illustration of a plug-in carbon monoxide detector powered by connection to an external source of electrical power 200. Several of the components of the plug-in carbon monoxide detector 200 are the same as in the battery-powered carbon monoxide detector 100. These include an audible alarm 115, a carbon monoxide sensor 120, and a controller 125. In addition, there is a power indicator 205 verifying connection to an active source of electric power. The externally-powered plug-in carbon monoxide detector 200 includes a plug 210 insertable into a receptacle 245 of a wall outlet 250 (FIG. 2C) to obtain power. The power indicator 205 shows whether there is sufficient voltage within the electrical outlet 250 to operate the plug-in carbon monoxide detector 200. The plug-in carbon monoxide detector 200 may include a battery 105 to provide power for a limited time in the event that outlet power is not available. FIG. 2B shows a side view of the externally powered plug-in carbon monoxide detector 200.

Figure 2C:
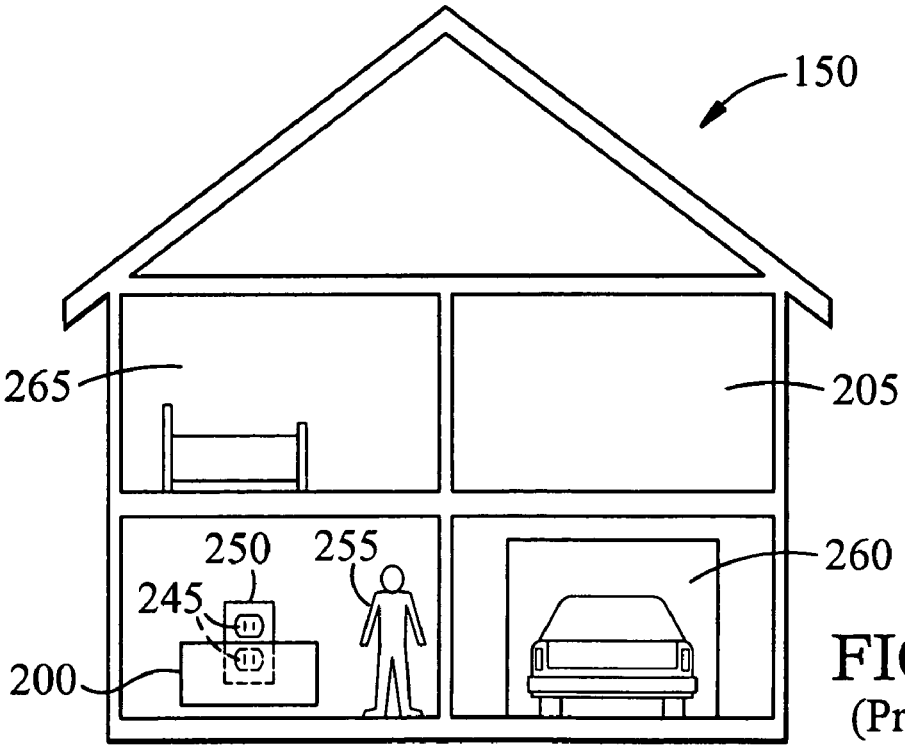
FIG. 2C (Prior Art)
FIG. 2C is a schematic illustration of a prior-art plug-in carbon monoxide detector installed in a dwelling.

FIG. 2C contains a schematic illustration of an installation of the externally-powered plug-in carbon monoxide detector 200 in a dwelling or structure 150. As shown, the externally-powered plug-in carbon monoxide detector 200 plugs into an existing electrical outlet 250. An advantage of the externally-powered plug-in carbon monoxide detector 200 is that it does not require regular replacement of batteries 105 as does the battery-powered carbon monoxide detector 100. As long as electrical power is available from the electrical outlet 250, the externally-powered plug-in carbon monoxide detector 200 functions and provides protection.

However, there are certain disadvantages to the externally-powered plug-in carbon monoxide detector 200. The externally-powered plug-in carbon monoxide detector 200 is fairly bulky and may prevent other appliances from using the electrical outlet 250. In addition, the plug 210 may be dislodged, for example, accidentally during cleaning, and the dislodgment not apparent. As a result, protection from overexposure to carbon monoxide is lost. Embodiments of the present invention may be able to avoid these difficulties.

Carbon monoxide detectors and smoke detectors may be combined in a single unit. However, disadvantages of a combined single unit include placement too high for effective carbon monoxide detection and where testing by fire inspectors is difficult. Further, most combined single units lack simulated voice and tone alarms that clearly distinguish between a fire emergency and a carbon monoxide emergency.

Figure 3:
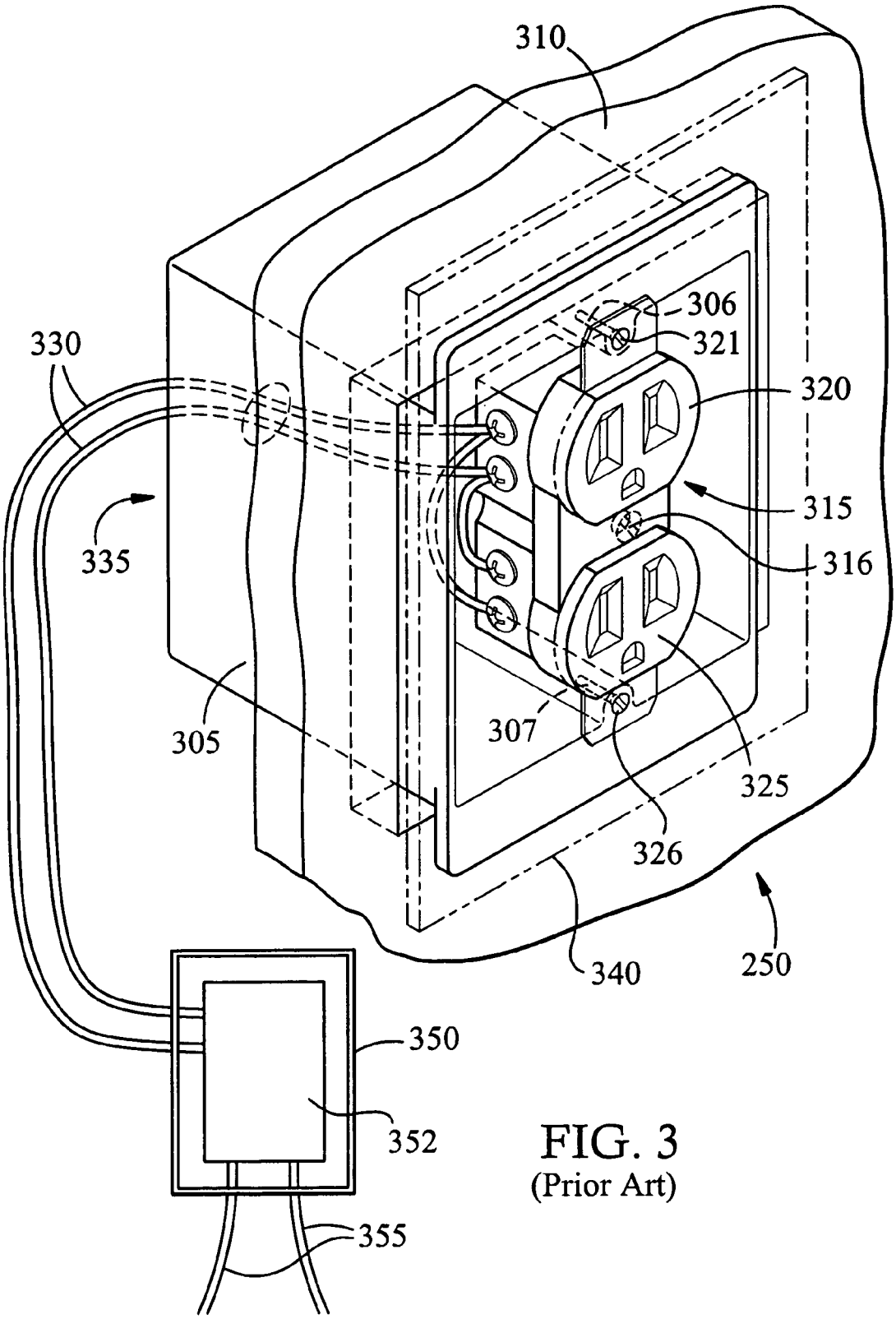
FIG. 3 (Prior Art)
FIG. 3 is a pictorial illustration of a prior-art installed wall electrical outlet box with installed duplex receptacle.

FIG. 3 contains a pictorial illustration of a prior art wall electrical outlet box 305 installed in a wall 310 of an existing structure or dwelling 150. The wall electrical outlet box 305 is attached to a wall 310. A duplex receptacle 315 is attached to the electrical outlet box 305 by screws 321 and 326 engaging tapped holes 306 and 307. A cover plate 340 (shown in phantom lines) is attached to duplex receptacle 315 by screw 316 and covers the wall electrical outlet box 305 while leaving access available to an upper electrical receptacle 320 and a lower electrical receptacle 325 of the duplex receptacle 315. Existing, previously installed, electrical wiring or electrical wires 330 connected to an electrical service panel 350 for the structure 150 and entering through the rear 335 of the wall electrical outlet box 305 connect to the upper electrical receptacle 320 and to the lower electrical receptacle 325. The electrical service panel 350 connects the electrical wires 330 to the utility service electrical line 355, a source of electrical power, through a device capable of disconnection 352, such as a circuit breaker. In this manner, the duplex receptacle 315 is hardwired or connected to the electrical service panel 350 within the dwelling or structure 150.

Figure 4A:
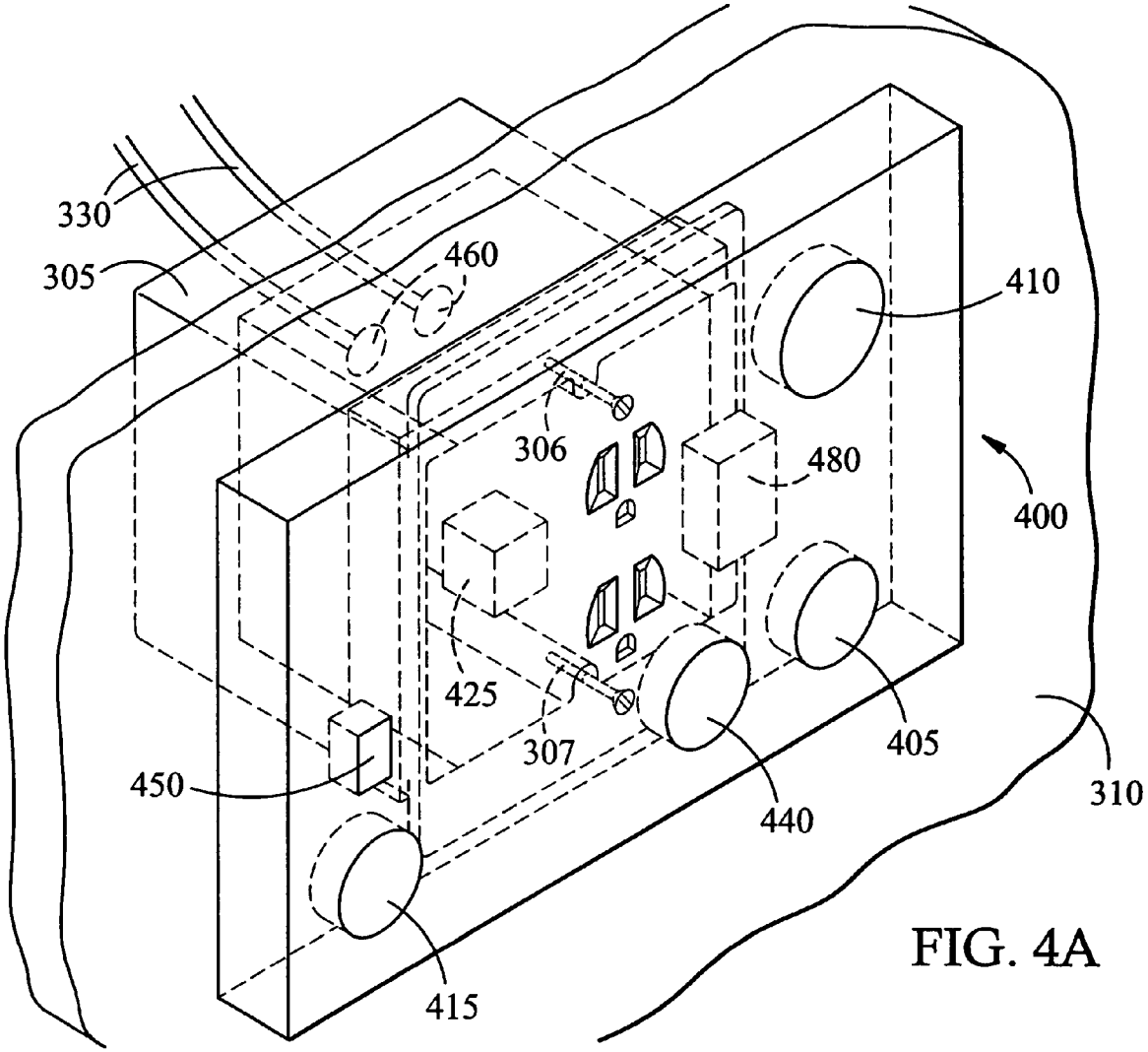
FIG. 4A is a pictorial illustration of a carbon monoxide detector according to an embodiment of the present invention installed in an existing or previously-installed wall electrical outlet box.

FIG. 4A contains a pictorial illustration of an embodiment according to the present invention of a hard-wired carbon monoxide detector 400 designed to retrofit within an existing electrical outlet 250. Carbon monoxide detector 400, for example, replaces the duplex receptacle 315 in the wall electrical outlet box 305 already coupled to a structure such as the wall 310 and, thus, installed in the dwelling 150, and already connected to the electrical wires or electrical wiring 330 of the dwelling 150. The cover plate 340 and the duplex receptacle 315 are removed from the installed wall electrical outlet box 305 and the hardwired carbon monoxide detector 400 is inserted in its place. The electrical wiring or wires 330 previously attached or coupled to the duplex receptacle 315 is used to bring electrical power to the hardwired carbon monoxide detector 400 from the electrical service panel 350. Once the electrical wires 330 are connected to the hardwired carbon monoxide detector 400 and the hardwired carbon monoxide detector 400 is attached to the installed wall electrical outlet box 305 using the tapped holes 306 and 307 previously used to attach the duplex receptacle 315 to the wall electrical outlet box 305, fitting substantially within the installed wall electrical outlet box 305, no cover plate 340 is required. The hardwired carbon monoxide detector 400 presents a low profile, substantially flush with the wall 310, that minimally extends beyond the wall 310 and is both visually and physically nonintrusive.

The hardwired carbon monoxide detector 400 includes a controller 425 coupled to a carbon monoxide sensor 440 and to one or more notification devices, which may be visual notification devices 405, audible notification devices 410, or a combination of both. The controller 425 sends a signal to the notification device if it receives another signal from the carbon monoxide sensor 440 indicating a carbon monoxide level exceeding a threshold.

The visual notification device 405 and the audible notification device 410 may emit an alarm signal to alert an occupant 255 (FIG. 2C) of the dwelling 150 that the carbon monoxide level in the area exceeds a threshold. An audible alarm signal may include a distinctive tone alarm or a simulated voice. The simulated voice may be a recorded message from a familiar voice to notify children of the potential danger and of the appropriate action. A visual alarm may be visual notification by a blinking display or an LCD display. The LCD display may be a numerical display indicating the level of carbon monoxide present to assist first responders in determining the level of danger and the severity of the situation.

In addition, the hardwired carbon monoxide detector 400 may contain a sensing device 415. The sensing device 415 may detect and respond to an alarm signal emitted by another hardwired carbon monoxide detector 400 within the dwelling 150 by sending a signal to the controller 425. The alarm signal from the other hardwired carbon monoxide detector 400 may be a visual alarm signal, an audible alarm signal, or a wireless alarm signal. The wireless alarm signal may be emitted by another carbon monoxide detector 400 by a transmitter 450. The LCD display of the visual notification device 405 of the hardwired carbon monoxide detector 400 may include identification of the other hardwired carbon monoxide detector 400, which detected the excessive carbon monoxide level.

Upon receipt of the signal from the sensing device 415, the controller 425 of the hardwired carbon monoxide detector 400 may cause its visual notification device 405 and/or the audible notification device 410 to emit an alarm signal indicative of a high carbon monoxide level. In such a manner, residents or occupants 255 are alerted to a dangerous level of carbon monoxide in an area remote from the area where they reside. For example, high carbon monoxide levels within a basement 260 may trigger visual notification devices 405 and/or audible notification devices 410 of hard-wired carbon monoxide detectors 400 near bedrooms 265.

The visual alarm and audible alarm signals emitted from the carbon monoxide detector 400 should be distinct from alarm signals emitted by detectors of other gases or of smoke so that a resident 255 can respond appropriately to the danger. For example, alarms from the carbon monoxide detector 400 may be distinguished from alarms or other types of detectors by the frequency of an audible alarm tone or the variation of a pulse frequency or a pulse shape of the audible alarm.

The hardwired carbon monoxide detector 400 also contains one or more electrical receptacles 420 that may be integral with the hardwired carbon monoxide detector 400. The electrical receptacles 420 may accept plugs from electrically powered devices such as electrical lamps and vacuum cleaners. As a result, although the hard-wired carbon monoxide detector 400 is installed in an already installed wall electrical outlet box 305, its installation does not diminish availability of electrical receptacles 420 within the room 205, as did the plug-in carbon monoxide detector 200.

Figure 4B:
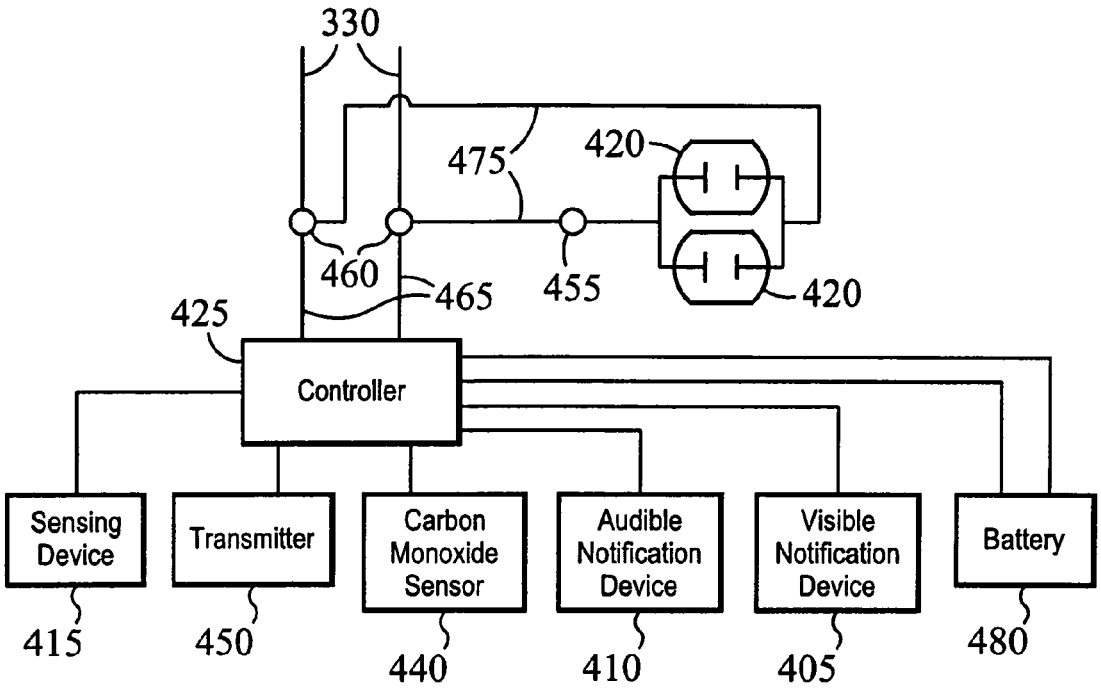
FIG. 4B is a schematic drawing of a carbon monoxide detector according to an embodiment of the present invention.

FIG. 4B contains a schematic drawing of the hard wired carbon monoxide detector 400 connected to the installed electrical wiring 330. The installed electrical wires 330 are coupled to the electrical terminals 460 of the hardwired carbon monoxide detector 400. The controller 425, the sensing device 415, the transmitter 450, the carbon monoxide sensor 440, the audible notification device 410, and the visual notification device 405 may be connected to the electrical terminals 460 through detector wires 465 and to the electrical receptacles 420 by receptacle wires 475. In this way, if the electrical receptacles 420 are disconnected from electrical terminals 460 by, for example, action of a ground fault indicator 455, hardwired carbon monoxide detector 400 remains electrically powered and responsive to excessive carbon monoxide levels. Installed electrical wiring or wires 330, detector wires 465, and receptacle wires 475 may include a positive connection, a negative connection, and a ground connection. Hardwired carbon monoxide detector 400 may include a backup battery 480 to provide electrical power in the event that electrical power through the installed wires 330 is unavailable.

Figure 5:
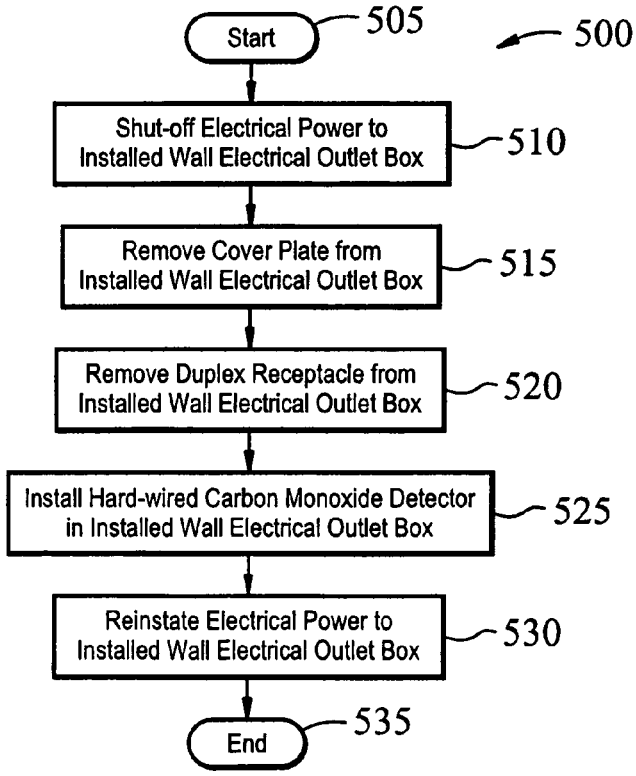
FIG. 5 is a flow chart illustrating a method according to an embodiment of the current invention for retrofitting an existing installed wall electrical outlet box with a hard-wired carbon monoxide detector.

FIG. 5 illustrates a method 500 for installing a hardwired carbon monoxide detector 400. In step 510, a source of electrical power to the wall electrical outlet box 305 is removed, as, for example, by means of a circuit breaker 352 included in the electrical service panel 350 and coupled to the installed wires 330 and to the electrical service 355. In step 515, the cover plate 340 covering a wall electrical outlet box 305 is removed. In step 520, a duplex receptacle 315 is removed from the installed wall electrical outlet box 305, where removal of the duplex receptacle 315 may include disconnecting the duplex receptacle 315 from an existing or installed electrical wire 330. In step 525, the hard-wired carbon monoxide detector 400 having the carbon monoxide sensor 440 and one or more electrical receptacles 420 is installed in the installed wall electrical outlet box 305, where installation of the hard-wired carbon monoxide detector 400 may include coupling the terminals 460 of the hardwired carbon monoxide detector 400 to the installed electrical wires 330. In the course of coupling the hardwired carbon monoxide detector 400 to the installed electrical wire 330, an electrical receptacle 420 may be coupled to the installed electrical wires 330, where the hardwired carbon monoxide detector 400 may be integral with the electrical receptacle 420. A positive installed electrical wire 330 may be connected with a positive electrical terminal 460, a negative electrical terminal wire 460 may be connected with a negative electrical terminal 460, and a ground electrical wire may be connected to a ground electrical terminal 460. Terminals 460 may be in the form of wires. In step 530, the source of electrical power to the wall electrical outlet box 305 is reinstated, as, for example, by means of the circuit breaker 352.

As a result of the installation of the hardwired carbon monoxide detector 400 in an installed wall electrical outlet box 305, there is uninterrupted carbon monoxide monitoring of the area in the vicinity of the hardwired carbon monoxide detector 400. The hardwired carbon monoxide detector 400 may be installed in an existing wall electrical outlet box 305 without reducing the number of electrical receptacles available to use by other electrical devices.

The hardwired carbon monoxide detector 400 may comply with state ordinances requiring a licensed electrician for installation and for an electrical permit. These requirements insure proper installation and require inspection by a state-approved inspector. A hardwired carbon monoxide detector 400 and its installation may provide assurance to residents 255 of the dwelling 150 that a qualified and permanent system for carbon monoxide detection has been installed and inspected.

Although the invention has been described with respect to various embodiments, it should be realized that this invention is also capable of a wide variety of further and other embodiments within the spirit and the scope of the appended claims.

What is claimed is:

1. A tamper proof carbon monoxide detector in combination with a wall electrical outlet box, the carbon monoxide detector comprising:

an integrated unit configured to fit within said wall electrical outlet box, said integrated unit comprises substantially completely therein a controller, a notification device, a carbon monoxide sensor, and two or more electrical terminals, said electrical terminals used to electrically connect said carbon monoxide detector to electrical wires emanating from said electrical outlet box;

said controller receives a first signal from said carbon monoxide sensor and generates a second signal, said first signal being indicative of carbon monoxide presence; and said notification device receives said second signal and produces an output based thereon.

2. The carbon monoxide detector combination of claim 1, wherein said notification device is a visual notification device.

3. The carbon monoxide detector combination of claim 1, wherein said notification device is an audible notification device.

4. The carbon monoxide detector combination of claim 1, in which said integrated unit further comprises:

a sensing device, said sensing device being coupled to said controller and being responsive to a third signal different from said first signal and said second signal, said third signal being emitted by another carbon monoxide detector.

5. The carbon monoxide detector combination of claim 1, wherein said sensing device is a wireless sensing device.

6. The carbon monoxide detector combination of claim 1, the carbon monoxide detector further comprising:

a wireless transmitter.

7. The carbon monoxide detector combination of claim 1,the carbon monoxide detector further comprising:

at least one electrical receptacle.

8. The carbon monoxide detector of claim 7, wherein said at least one electrical receptacle is integral with said carbon monoxide detector.

9. The carbon monoxide detector combination of claim 1, wherein said wall electrical outlet box is located within a wall.

10. The carbon monoxide detector combination of claim 9, wherein the carbon monoxide detector, when mounted within said wall electrical outlet box, is substantially flush with said wall.

11. The carbon monoxide detector combination of claim 10, wherein said two or more electrical terminals are two or more electrical wires.

12. The carbon monoxide detector combination of claim 1, in which said integrated unit further comprises:

a battery.

13. A method for retrofitting an installed wall electrical outlet box with a carbon monoxide detector, the method comprising:

removing a source of electrical power from the wall electrical outlet box;

removing a cover plate from the installed wall electrical outlet box, the installed wall electrical outlet box containing two or more electrical wires;

providing a carbon monoxide detector comprising:

an integrated unit configured to fit within said wall electrical outlet box, said integrated unit comprises substantially completely therein a controller, a notification device, a carbon monoxide sensor, and two or more electrical terminals, said electrical terminals used to electrically connect said carbon monoxide detector to one or more electrical wires emanating from said electrical outlet box:

said controller receives a first signal from said carbon monoxide sensor and generates a second signal, said first signal being indicative of carbon monoxide presence; and said notification device receives said second signal and produces an output based thereon;

removing an at least one receptacle from the installed wall electrical outlet box;

disconnecting the at least one receptacle from at least two electrical wire of the installed wall electrical outlet box;

installing said carbon monoxide detector in the installed wall electrical outlet box;

coupling electrical terminals of the carbon monoxide detector to two or more electrical wires of the installed wall electrical outlet box;

coupling at least one electrical receptacle of the carbon monoxide detector to the at least two electrical wires of the installed wall electrical outlet box; and reinstating the source of electrical power to the wall electrical outlet box.

* * * * *